US010322414B2

(12) United States Patent
Musil

(10) Patent No.: US 10,322,414 B2
(45) Date of Patent: Jun. 18, 2019

(54) ROLLER BEARING CONE CRUSHER AND PLAIN BEARING CONE CRUSHER WITH A COMMON EXTERIOR CONFIGURATION

(71) Applicant: TEREX USA, LLC, Westport, CT (US)

(72) Inventor: Joseph E Musil, Ely, IA (US)

(73) Assignee: Terex USA, LLC, Westport, CT (US)

( * ) Notice: Subject to any disclaimer, the term of this patent is extended or adjusted under 35 U.S.C. 154(b) by 461 days.

(21) Appl. No.: 15/160,012

(22) Filed: May 20, 2016

(65) Prior Publication Data

US 2016/0339440 A1 Nov. 24, 2016

Related U.S. Application Data

(60) Provisional application No. 62/164,845, filed on May 21, 2015.

(51) Int. Cl.
*B02C 2/00* (2006.01)
*B02C 2/04* (2006.01)

(52) U.S. Cl.
CPC ..... *B02C 2/04* (2013.01)

(58) Field of Classification Search
CPC .. B02C 2/04; B02C 2/042; B02C 2/06; B02C 2/08; B02C 2/045; B02C 2/02; B02C 25/00; B02C 2/00; E21F 13/002; F23J 1/00
See application file for complete search history.

(56) References Cited

U.S. PATENT DOCUMENTS

| | | | | |
|---|---|---|---|---|
| 2,701,107 A * | 2/1955 | Johnson | B02C 1/06 241/140 |
| 3,811,626 A * | 5/1974 | Kemnitz | B02C 2/04 241/214 |
| 4,589,600 A * | 5/1986 | Schuman | B02C 2/04 241/208 |
| 6,446,892 B1 * | 9/2002 | Fasoli | B02C 2/04 241/207 |
| 2008/0099589 A1 * | 5/2008 | Stemper | B02C 2/04 241/27 |

* cited by examiner

*Primary Examiner* — Jun S Yoo
(74) *Attorney, Agent, or Firm* — Simmons Perrine Moyer Bergman PLC

(57) ABSTRACT

Cone crushers with differing main bearing styles therein being manufactured with interchangeable parts and with a common exterior configuration so that a roller bearing cone crusher could be replaced at a crushing site by a plain bearing cone crusher without the need for any modification to either the plain bearing crusher or the crushing site. Methods of manufacturing roller bearing cone crushers which have components therein which are interchangeable with components in a plain bearing cone crusher is also disclosed.

6 Claims, 3 Drawing Sheets

ROLLER BEARING CONE CRUSHER AND PLAIN BEARING CONE CRUSHER WITH A COMMON EXTERIOR CONFIGURATION

CROSS REFERENCE TO RELATED APPLICATIONS

This application claims the benefit of the filing date of the provisional patent application filed on May 21, 2015, and having Ser. No. 62/164,845, by the same inventor, with the title, "CONE CRUSHER WITH ALTERNATE BEARING ROLLER/PLANE" which application is incorporated herein by reference in its entirety.

FIELD OF THE INVENTION

The present invention relates to material processing equipment and cone crusher systems.

BACKGROUND OF THE INVENTION

Cone crushers used in material processing can often be broadly categorized as either roller bearing or plain bearing cone crushers (a.k.a. plane bearing cone crushers). Indeed, in the past decades, a typical cone crusher customer might have a strong preference to either roller main shaft bearings or plain main shaft bearings. If a plain main bearing preferring cone crusher customer were to purchase a crushing business with a pre-existing crushing operation utilizing a roller main bearing cone crusher, there often might be a desire to eventually replace a worn out roller main bearing cone crusher with a plain main bearing cone crusher. However, this could, at times, be substantially more difficult and time consuming than merely purchasing a replacement cone crusher of the same make and model. A plain main bearing style of crusher will typically be made by a different manufacturer, because typically, in the past, cone crusher manufactures have made either roller bearing cone crushers or plain bearing cone crushers, but not both. Consequently, plain bearing cones have different exterior configurations and interfaces, e.g. chassis mounting structures and bolts and input and output conveyors etc. than would a roller main bearing style machine; even if the two types of machines have roughly the same size and performance characteristics. Therefore, the replacement of an existing crusher with one having a different style main bearing would typically result in a need to make non-desired and non-trivial site modifications or even less desirable modifications to the new replacement cone crusher.

While prior art cone crushers have enjoyed considerable success in the past, there exists a need for improvement in several respects. The following description of the present invention is intended to address some of these needs.

SUMMARY OF THE INVENTION

It is an object of the present invention to provide an interchangeability feature for a plurality of cone crushers with differing styles of main bearings.

It is a feature of the present invention to provide non-differing external interfaces on cone crushers with differing main bearing types.

It is an advantage of the present invention to allow for a "swappable replacement" of a first cone crusher with a first main bearing style with a second cone crusher with a differing second main bearing style without the need to make crushing site or chassis mounting modifications or modifications to the second crusher.

It is another object of the present invention to utilize a plurality of common components between a roller main bearing style cone crusher and a plain main bearing style crusher.

It is another feature of the present invention to include a low combined SKU component list for two similarly sized cone crushers with differing main bearing styles.

It is another advantage of the present invention to allow for decreased inventory expense.

The present invention is designed to achieve the above-mentioned objectives, include the previously stated features, and provide the aforementioned advantages.

The present invention is a system for crushing rock with alternate main bearing types while maintaining a common exterior mounting and I/O interface configuration.

DETAILED DESCRIPTION OF THE INVENTION

Figure 1:
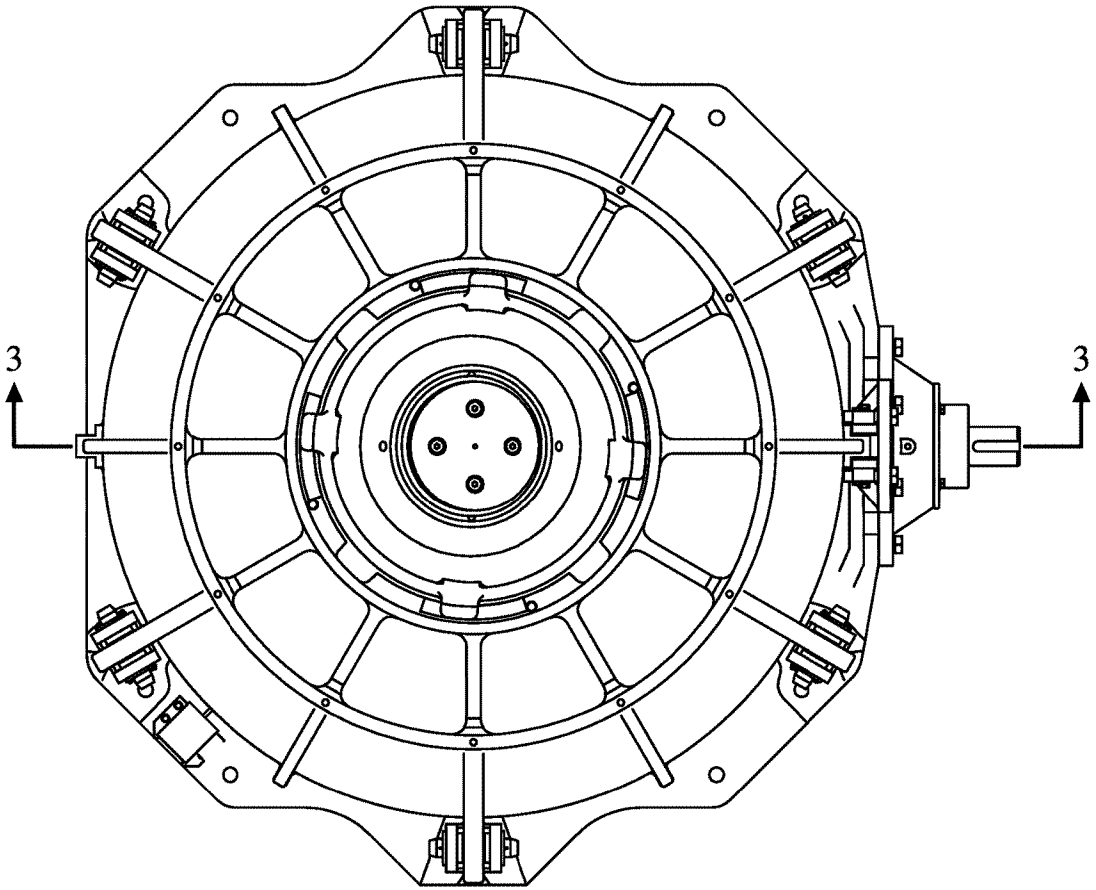
FIG. 1 is a top view of a cone crusher of the present invention.

Now referring to the drawings wherein like numerals therein and below will refer to like structure throughout. With reference to FIG. 1, there is shown a top view of a cone crusher. This exterior portion of this cone crusher will be virtually identical to the exterior portions of the internally different cones crushers shown in FIGS. 2 and 3. One key aspect of FIG. 1 is that the size, mounting locations and other exterior structure such as material input and discharge interfaces are functionally equivalent between the crushers of FIGS. 2 and 3 so the exterior view of these crushers can be represented by a single figure.

Figure 2:
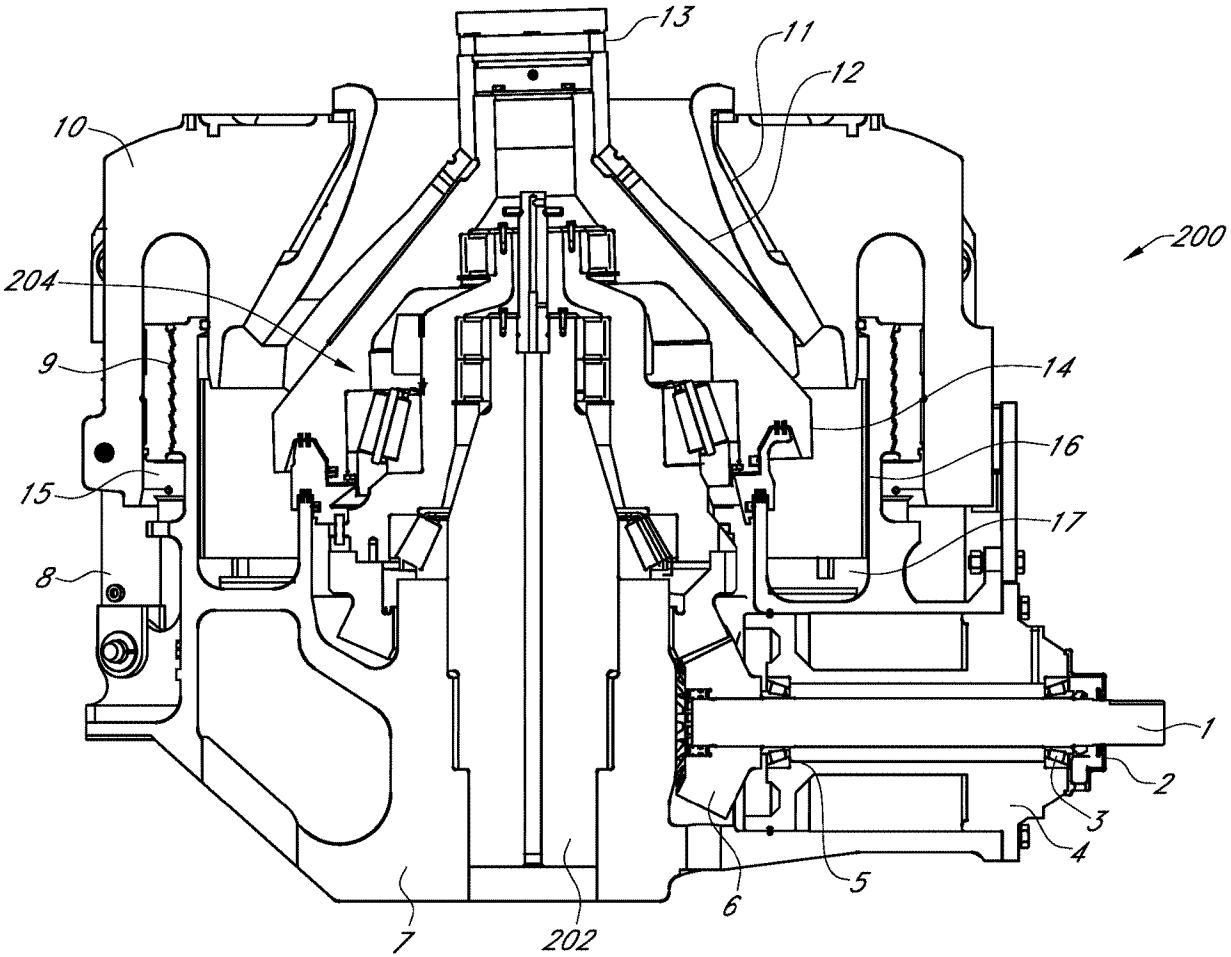
FIG. 2 is a cross-sectional view taken on line A-A of FIG. 1 when it is taken to represent a roller bearing cone crusher.

Now referring to FIG. 2, there is shown one cone crusher of the present invention. This roller bearing cone crusher, generally designated 200, when examined in isolation, (without reference to the plain bearing cone crusher of FIG. 3) is made of many components, assemblies and sub-assemblies that are similar in many respects to prior art roller bearing cone crushers. It is believed that a person skilled in the art of making roller bearing cone crushers could make, without undue experimentation, a crusher which contains structure which fits the general description of this FIG. 2. Indeed, it is believed persons skilled in the art have made cone crushers which are comprised of components which are functionally very similar to components of the system shown in FIG. 2 (except for its similarity to FIG. 3).

Roller bearing cone crusher 200 is shown having a main frame casting 7, which could be a cast steel piece which is machined after the casting. Roller cone main shaft 202 is shown disposed in main frame casting 7. Also shown in FIG. 2 are a plurality of roller bearing cone crusher main shaft bearings.

Figure 3:
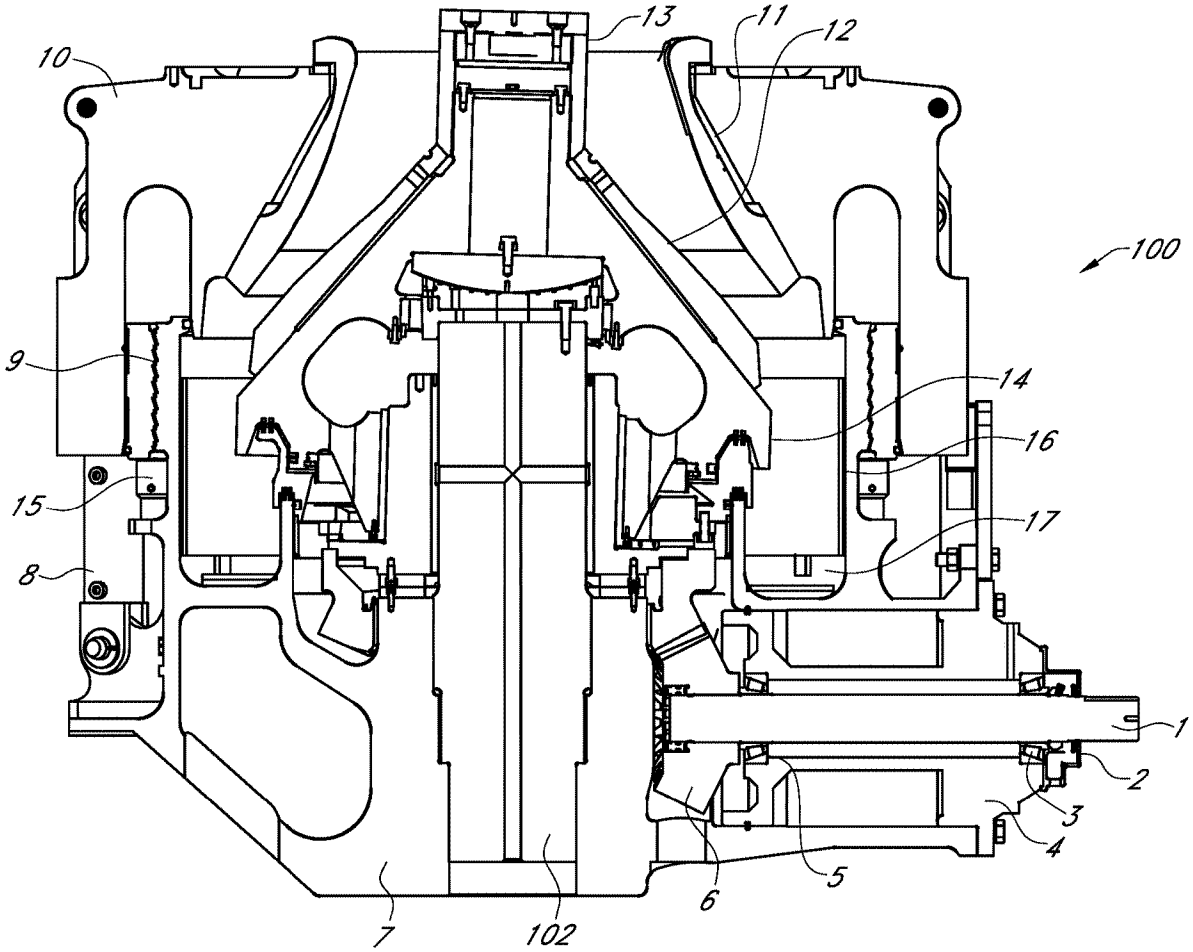
FIG. 3 is a cross-sectional view taken on line A-A of FIG. 1 when it is taken to represent a plain bearing cone crusher.

Now referring to FIGS. 2 and 3, there is shown the following structures which could be identical in the two cone crusher designs: Pinion shaft 1 is shown together with pinion seal 2, pinion outer bearing 3, pinion housing 4, pinion inner bearing 5 and pinion and eccentric gear set 6. Tramp iron relief system 8, closed side setting screw adjust 9 which could be any type of adjustment mechanism for changing the close site setting, upper assembly 10 (bonnet), which may comprise a cast steel member which forms a cover over the cone, upper wear liner 11, lower wear liner 12, retention system 13, seal assembly 14, upper locking system 15, wall liner 16, and strut liner 17 are also shown. It should be understood that other parts may be made identical between the roller bearing cone crusher and the plain bearing cone crusher or fewer parts may be made identical. The present invention does, however, contemplate that a plurality of these items 1-6 and 8-17 will be identical in a roller bearing cone crusher and in a plain bearing cone crusher. Additionally, the exterior bottom contoured surface of the main frame casting is substantially identical in FIGS. 2 and 3.

The structures shown in FIGS. 2 and 3 that appear to be the same could, if desired, all be made to be identical or interchangeable in both the roller bearing cone crushers and in the plain bearing cone crushers. The parts that appear different will likely be parts that are different and will not be interchangeable between roller cone crushers and plain bearing cone crushers. For example, the eccentric, the main shaft, and main shaft bearings will not be identical between a roller bearing cone crusher and a plain bearing cone crusher. The common exterior configuration innovation of the present invention is intended to apply to all roller bearing/plain bearing cone crusher type pairs irrespective of size, and crusher throughput capacity.

Now referring to just FIG. 3, there is shown a plain bearing cone crusher of the present invention generally designated 100 which has a plain bearing main shaft 102. It should be understood that the main shaft in crusher 100 and crusher 200 are not identical. However, it is possible that the bottom portion of the main shafts of these could be made to be identical so that they will mate with portions of the main frame casting 7 after they have been machined to have substantially identical bottom portions. As is shown in FIGS. 2 and 3, the main shafts may be made to be entirely different. It should be understood that even if no portion of these main shafts are the same in roller bearing cone crushers and in the plain bearing cone crushers, the main frame casting 7 could start out with identical main frame castings which could then be machined differently, even at their bottom portions to accommodate different main shaft bottom portions. Also, shown in FIG. 3 is a plain bearing cone crusher main shaft bearing.

The present invention is also a method of manufacturing both roller bearing cone crushers and plain bearing cone crushers which comprises the following steps:

1. Provide an interchangeable parts inventory of a plurality of different parts or sub-assemblies which are interchangeable and which can be used on either a roller bearing cone crusher or a plain bearing cone crusher;

2. Provide a main shaft inventory of main shafts which comprise a first plurality of roller bearing cone crusher main shafts and a second plurality of plain bearing cone crusher main shafts; where the first plurality and the second plurality of shafts are not interchangeable.

3. Provide a bearing inventory of main shafts bearings which comprise a first plurality of roller bearing cone crusher main shaft bearings and a second plurality of plain bearing cone crusher main shaft bearings; where the first plurality and the second plurality of bearings are not interchangeable.

4. Provide an eccentric inventory of eccentrics which comprise a first plurality of roller bearing cone crusher eccentrics and a second plurality plain bearing cone crusher eccentrics; where the first plurality and the second plurality of eccentrics are not interchangeable.

5. Assemble a plurality of cone crushers including:

a roller bearing cone crusher by combining: a plurality of interchangeable parts from the interchangeable parts inventory; a shaft from said first plurality of shafts; an eccentric from said first plurality of eccentrics; and a bearing from said first plurality of bearings; and a plain bearing cone crusher by combining: a plurality of interchangeable parts from the interchangeable parts inventory; a shaft from said second plurality of shafts; an eccentric from said second plurality of eccentrics; and a bearing from said second plurality of bearings.

The method of the present invention may include at least one of the additional steps 1A and 1B:

Step 1A: Machine a portion of the main frame casting 7, in an upper portion, to accommodate a bearing from said first plurality of bearings and not accommodate a bearing from said second plurality of bearings.

Step 1B: Machine a portion of the main frame casting 7 to accommodate a bottom portion of a shaft selected from either said first plurality of shafts and said second plurality of shafts.

Although the invention has been described in detail in the foregoing only for the purpose of illustration, it is to be understood that such detail is solely for that purpose and that variations can be made therein by those of ordinary skill in the art without departing from the spirit and scope of the invention as defined by the following claims, including all equivalents thereof. The present invention could be utilized in a mobile crushing site where the crusher are mounted to a mobile chassis or a more permanent installation which does not include wheels for transporting the crusher. Throughout this description above and in the claims below, items which are discussed as being "identical" are hereby defined herein to mean, merely sufficiently similar that they are functionally equivalent and, without a need for any modification, capable for being useful in association with both a roller bearing cone crusher and a plain bearing cone crusher. It is not the intention of the present invention that such items need be aesthetically the same or the same at a microscopic level or a level which is not necessary to provide functional interchangeability.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

What is claimed is:

1. A method of manufacturing material processing equipment comprising the steps of:

providing an interchangeable parts inventory of a plurality of interchangeable parts which can be used on either a roller bearing cone crusher or a plain bearing cone crusher;

providing a main shaft inventory of main shafts which comprise a first plurality of shafts which are roller cone main shafts and a second plurality of shafts which are plain bearing main shafts; where a first shaft in the first plurality of shafts and a second shaft in the second plurality of shafts are not interchangeable;

providing a bearing inventory of main shafts bearings which comprise a first plurality of bearings which are roller bearing cone crusher main shaft bearings and a second plurality of bearings which are plain bearing cone crusher main shaft bearings; where the first plurality of bearings and the second plurality of bearings are not interchangeable;

providing an eccentric inventory of eccentrics which comprise a first plurality of eccentrics which are roller bearing cone crusher eccentrics and a second plurality of eccentrics which are plain bearing cone crusher eccentrics; where the first plurality and the second plurality of eccentrics are not interchangeable; and assembling a plurality of cone crushers each with a common exterior configuration, the plurality of cone crushers comprising:

a roller bearing cone crusher by combining a first plurality of interchangeable parts from the interchangeable parts inventory; a shaft from said first plurality of shafts; an eccentric from said first plurality of eccentrics; and a bearing from said first plurality of bearings; and a plain bearing cone crusher by combining a second plurality of interchangeable parts from the interchangeable parts inventory; a shaft from said second plurality of shafts; an eccentric from said second plurality of eccentrics; and a bearing from said second plurality of bearings.

2. The method of claim 1 further comprising at least one of the additional steps:

machining a portion of a main frame casting, in an upper portion, to accommodate a bearing from said first plurality of bearings and not accommodate a bearing from said second plurality of bearings; and machining a portion of the main frame casting to accommodate a bottom portion of a shaft from said first plurality of shafts and said second plurality of shafts.

3. The method of claim 1 wherein said plurality of cone crushers each has a main frame with an identical exterior bottom contoured surface.

4. The method of claim 3 wherein said plurality of cone crushers each has a main frame which originates from an identical main frame casting.

5. The method of claim 1 wherein said first plurality of interchangeable parts is identical to said second plurality of interchangeable parts.

6. The method of claim 5 wherein said first plurality of interchangeable parts comprise a pinion gear.

* * * * *